US008227963B2

(12) United States Patent
Paik

(10) Patent No.: US 8,227,963 B2
(45) Date of Patent: Jul. 24, 2012

(54) LIGHTING DEVICE

(75) Inventor: Dongki Paik, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/074,470

(22) Filed: Mar. 29, 2011

(65) Prior Publication Data

US 2011/0210657 A1 Sep. 1, 2011

(30) Foreign Application Priority Data

Jun. 23, 2010 (KR) ..... 10-2010-0059556

(51) Int. Cl.
*H01J 1/02* (2006.01)

(52) U.S. Cl. ..... 313/46; 313/318.09

(58) Field of Classification Search ..... 313/46, 313/318.01, 318.04, 318.09, 318.1, 318.12; 362/294

See application file for complete search history.

(56) References Cited

U.S. PATENT DOCUMENTS 7,540,761 B2 * 6/2009 Weber et al. ..... 439/487
7,728,345 B2 * 6/2010 Cao ..... 257/99
2009/0244899 A1 10/2009 Chyn
2010/0097797 A1 * 4/2010 Chen et al. ..... 362/234
2011/0156567 A1 * 6/2011 Wang et al. ..... 313/46
2011/0169406 A1 * 7/2011 Weekamp et al. ..... 315/32

FOREIGN PATENT DOCUMENTS

KR 1020090102026 A 9/2009
KR 100966599 B1 6/2010
KR 1020100058807 A 6/2010
KR 1020100064800 A 6/2010

OTHER PUBLICATIONS

Korean Prior Art Search Report dated Mar. 31, 2011.

* cited by examiner

*Primary Examiner* — Bumsuk Won
(74) *Attorney, Agent, or Firm* — KED & Associates, LLP

(57) ABSTRACT

A lighting device is disclosed herein. The lighting device may include an LED module having a plurality of LEDs and a heat sink that dissipates heat generated by the LEDs. The heat sink may be electrically insulated from the LEDs and other electrical components to improve the inner voltage property of the lighting device. In the lighting device as disclosed herein, a number of connectors required to assemble the various components of the lighting device may be reduced, and efficiency during assembly may be improved accordingly.

20 Claims, 5 Drawing Sheets

(a)

(b)

LIGHTING DEVICE

CROSS-REFERENCE TO RELATED APPLICATION(S)

This application claims the benefit of the Patent Korean Application No. 10-2010-0059556, filed in Korea on Jun. 23, 2010, which is incorporated herein by reference in its entirety.

BACKGROUND

1. Field

The present invention relates to a lighting device, more particularly, to a lighting device having improved light distribution efficiency and improved assembling.

2. Background

Lighting devices are known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

A lighting device as embodied and broadly described herein may include a light emitting module (light module) having at least one light emitting element provided therein. Simply for ease of explanation, the lighting emitting element is disclosed herein as being an LED or LED element. However, the present disclosure is not limited thereto. Various types of light emitting elements and light emitting modules may be applicable to the present disclosure. The light emitting module may be any appropriate device that generates light when a voltage is applied thereto. The lighting device as disclosed herein allows a more efficient utilization and conservation of energy resources.

In light emitting diodes (LEDs) or LED devices, a small number of carriers may be injected at a semiconductor p-n junction. When the carriers are recombined, light may be emitted from the LED or LED device. The wavelengths and color of the resulting light may be different based on the types of impurities which are added. For example, the luminescent light related to elements Zinc and Oxygen is red (wavelength of 700 nm), while the light related to Nitrogen is green (wavelength of 550 nm).

An LED may have a compact size and smaller form factor, longer life span, excellent efficiency, and high response speeds when compared to conventional light sources such as incandescent light sources. However, power consumption of an LED device may be relatively large and may generate a large amount of heat. Hence, an auxiliary heat sink may be provided to enhance heat dissipation.

The heat sink may be made of a material having a high thermal conductivity such as metal to absorb and quickly radiate heat generated by an LED module having a plurality of LEDs mounted therein. The LED module may be coupled to the heat sink using a coupling member (fastener or connector) such as a bolt or another appropriate type of fasteners or connectors.

If the LEDs in the LED module are mounted on a metal substrate, the coupling member may electrically connect the metal substrate to the heat sink and a short circuit may exist between the LED module and the heat sink. Because the outer surface the heat sink may be exposed, a danger of electric shock or a deterioration of device voltage levels may result. Moreover, the number of connectors which may be necessary to connect each of the components of the lighting device may increase which, in turn, may deteriorate productivity or efficiency during assembly as well as increase the cost of the device.

Figure 1:
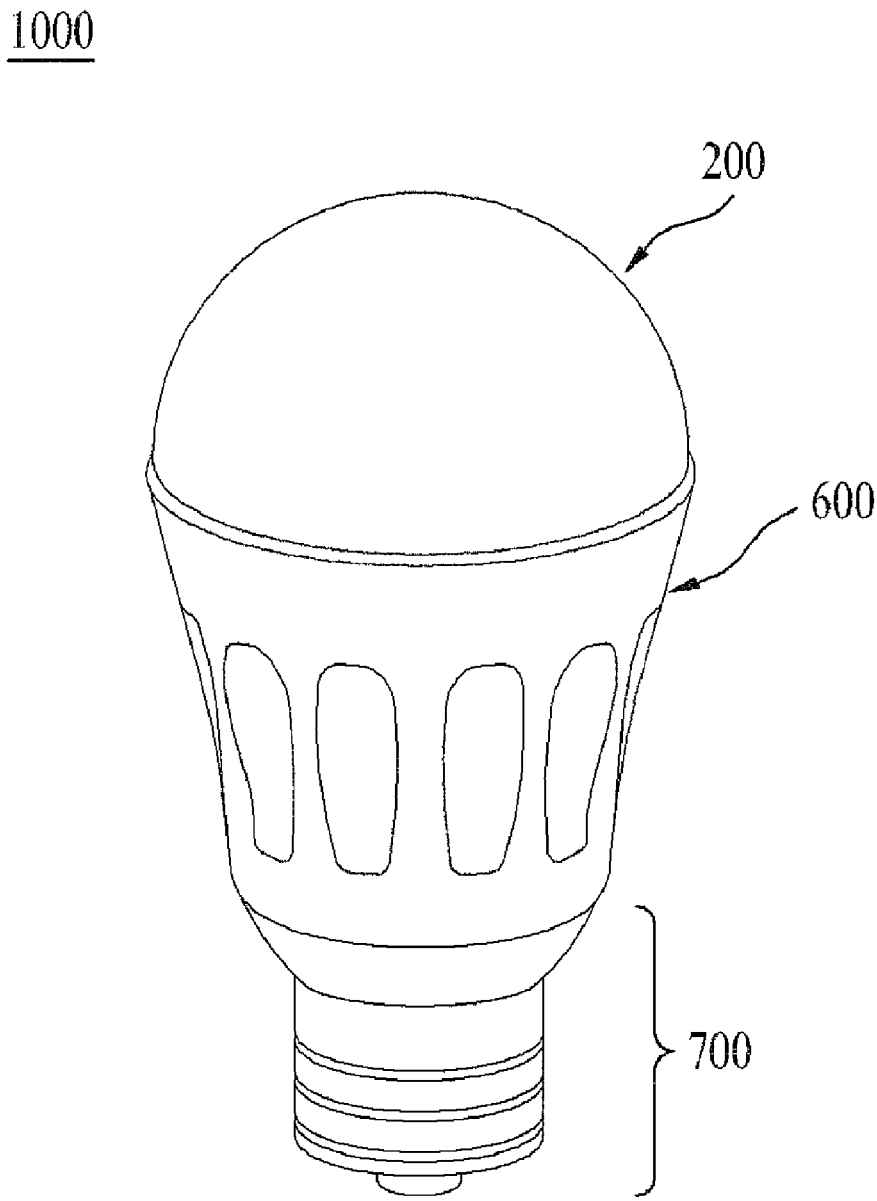
FIG. 1 is a perspective view of a lighting device according to an embodiment of the present disclosure.

FIG. 1 is a perspective view of a lighting device according to an embodiment of the present disclosure. The lighting device 1000 according to this embodiment may include an LED module having an LED mounted therein, a main body 600 which may be configured as a heat sink to dissipate heat generated by the LED module, and a base 700 that may house an electrical control module configured to convert a high input voltage (commercialized voltage) into an input voltage appropriate for the LED module. The base 700 and the LED module may be connected to each other such that the heat sink 600 positioned therebetween. Moreover, the LED module may include a substrate on which the LEDs may be mounted.

The LED module may be provided at an upper portion of the main body 600. Lens 200 may be provided over the LED module to diffuse or project light emitted from the LED module. The lens 200 may be a diffusing cap if simple diffused lighting is desired. If the lighting device 1000 is designed to emit projected light, the lens 200 may be a projection lens that may project the emitted light in a predescribed direction.

The lens or diffusing cap 200 may be made of a mixture of a resin material and pigment. The light may be scattered or diffused by the diffusing cap 200 as the emitted light particles collide with the pigment particles. When the diffusing cap 200 is used, the directionality of the light may be removed to more effectively disperse the emitted light. The diffusing cap 200 may be connected to the heat sink 600 in which the LED module is secured, as described in further detail hereinbelow.

The base 700 may house the electrical control module. The electrical control module may include various electrical components configured to convert a commercial voltage into an input voltage that is compatible with the LED module. The base 700 may be provided at a lower portion of the main body 600.

The base 700 may include an electrical connector (electric socket) configured to supply the high input voltage to the electrical control module. Here, the electrical control module may convert the high input voltage into the input voltage of the LED module. Typically, LEDs may require a DC voltage while input power may be an AC power source. Hence, the electrical control module may include electrical components such as an AC-DC converter, a voltage regulator to control the output voltage level, or another appropriate controller circuitry. Moreover, as the main body 600 may be made of metal components and configured as a heat sink for the LED module, the base 700 may be formed of heat insulting materials to thermally insulate the electrical control module from heat generated by the LEDs. The base 700 may also be formed of a material which may also electrically insulate the base 700 from the main body 600.

Figure 2:
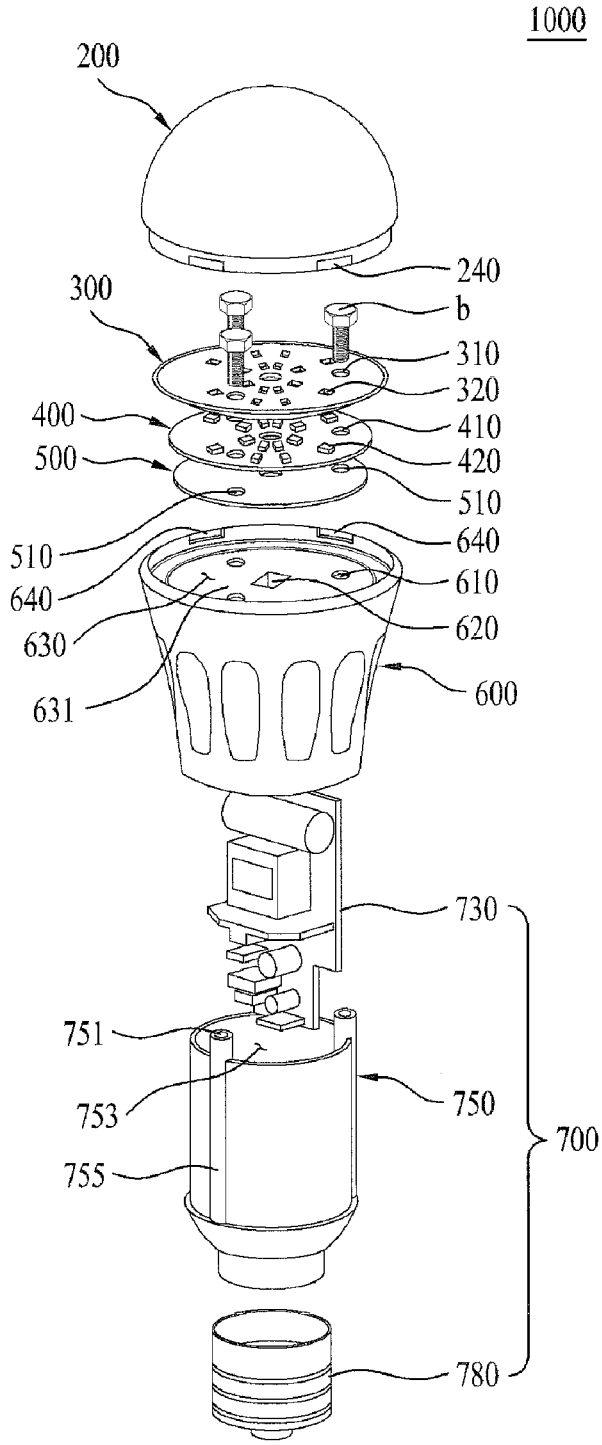
FIGS. 2 and 3 are exploded perspective views of the lighting device of FIG. 1.
Figure 3:
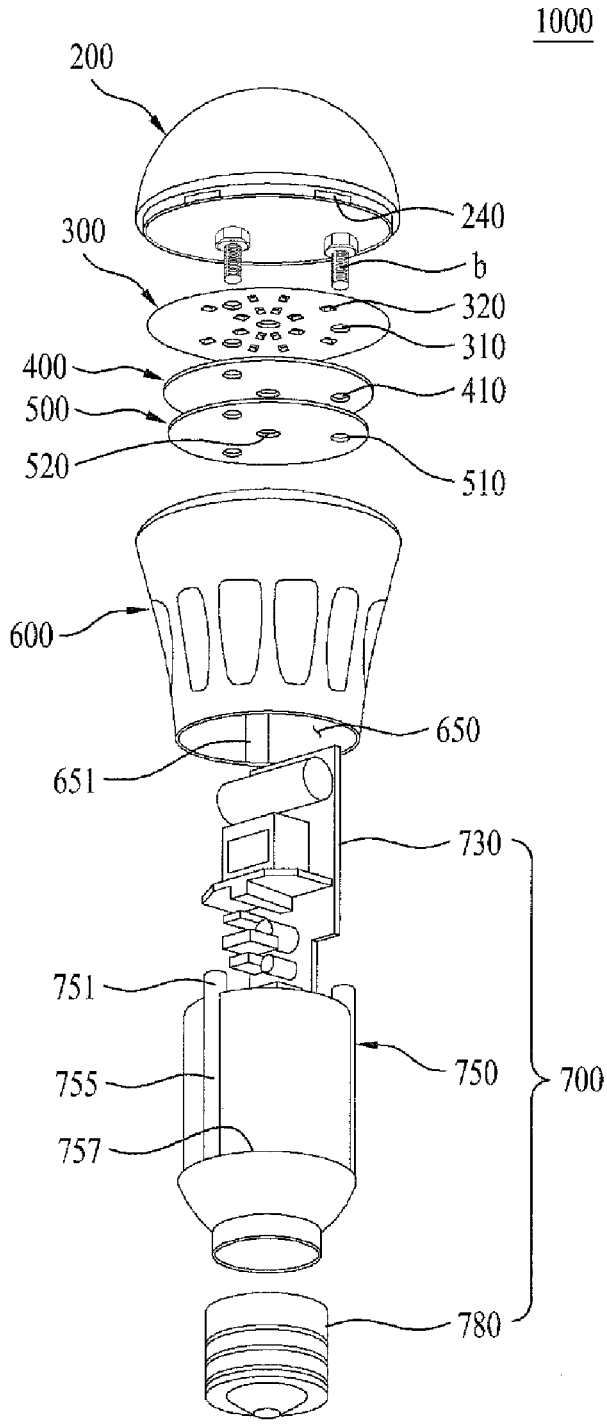

FIGS. 2 and 3 are exploded perspective views of the lighting device 1000 of FIG. 1. FIG. 2 is an exploded perspective view from above the lighting device 1000, and FIG. 3 is an exploded perspective view from below the light device. Referring to FIG. 2, the lighting device 1000 according to this embodiment may include the LED module 400 having a plurality of LEDs 420. The LED module 400 may include a substrate on which the plurality of the LEDs 420 may be mounted. The substrate may be formed of a metal material to quickly transfer heat generated by the LEDs 420 away from the LED module 400 toward the main body 600. The main body 600 may be a heat sink to dissipate the heat generated by the LEDs 420.

The substrate of the LED module 400 may include a coupling hole 410 to accommodate a fastener b. The fastener b may be a connector including, for example, a screw, bolt, rivet, or another appropriate type of connector. The LED module 400 may be secured in an upper portion of the heat sink 600. The heat sink 600 may include a predetermined securing space 630 to secure the LED module 400 therein. The securing space 630 may be a recess or cavity formed at the upper portion of the heat sink 600. The LED module 400 may be secured in the upper cavity 630 such that heat generated by the LED module 400 may be transferred to the heat sink 600.

A heat conduction pad 500 may also be provided between the LED module 400 and the heat sink 600 to improve thermal conductivity between the LED module 400 and the heat sink 600. The heat conduction pad 500 may include a coupling hole 510 for the connector b that connects the LED module to the heat sink 600. The coupling hole 510 may be positioned to correspond to a position of the coupling hole 410 on the LED module 400. Moreover, the heat conduction pad 500 may maximize heat transfer between the LED module 400 and the heat sink 600. For example, the heat conduction pad 500 may be formed of a thermally conductive material that is flexible to increase the contact surface between the LED 400 and the heat sink 600.

In certain embodiments, a heat sink compound, or another thermally conductive material, may be applied between the heat sink 600 and the LED module 400 to improve thermal conductivity and heat sink performance. In certain embodiments, the heat sink compound may also be an adhesive material that may secure the LED module 400 to the heat sink 600.

A reflector 300 (reflecting member) may be provided on the LED module 400. The reflector 300 may include a plurality of LED holes 320 that correspond to the LEDs provided on the LED module 400. For example, when the LEDs 420 are mounted in the LED module 400 in a radial arrangement, the LED holes 320 provided in the reflector 300 may also be arranged in the radial arrangement to correspond to the LEDs 420, as shown in FIG. 2.

The reflector 300 may include a coupling hole 310 to accommodate the connector b therein. As a result, the connector b may be configured to couple the reflector 300, LED module 400, the heat conduction pad 500, the heat sink 600, and the base 700 to each other through each respective coupling holes 310, 410, 510, 610 and a coupling boss 751. The connection of connector b and coupling holes 310, 410, 510, 610 and a coupling boss 751 is described in further detail herein below.

The reflector 300 may be formed of a material which is highly reflective. The reflector 300 may improve the efficiency of the lighting device 1000 by redirecting scattered or diffused light back toward the lens 200. For example, the reflector 300 may reflect and redirect light which may be reflected back into the upper cavity 630 by the lens 200 or emitted from the LEDs 420 in a lateral direction along a surface of the metal substrate or the upper cavity 630.

The heat sink 600 may be formed of a metal material that may effectively radiate heat generated by the LED module 400. The upper cavity 630 may be provided in the upper portion of the heat sink 600 and a lower cavity 650 (inserting space) may be provided at a lower portion of the heat sink 600. The base 700 may be placed inside the lower cavity 650. That is, a bottom surface (dividing wall or mounting plate) of the upper cavity 630 may separate or divide the upper cavity 630 and the lower cavity 650 from each other within the heat sink 600. The surfaces of the upper and lower cavities 630 and 650 as well as the dividing wall may be formed of metal.

The base 700 may include the electrical control module 730, a heat insulating housing 750 (heat-insulating member), and electrical connector 780. The electrical control module may include electric circuitry configured to convert a commercial input voltage into a voltage that is compatible with the LED module 400. The heat-insulating housing 750 configured to house the electrical control module 730. For example, the heat-insulating housing 750 may include a cavity 753 (accommodating space) formed therein to house the electrical control module 730. The electrical control module 730 may be positioned inside the cavity 753 and may be protected from heat from the heat sink 600. The heat-insulating housing 750 may be formed of a heat insulating material to insulate the electrical control module 730 from heat radiated from the heat sink 600. The heat-insulating housing 750 may also be formed of a material that is an electrical insulator to prevent short circuits between the electrical control module 730 and the heat sink 600.

The heat-insulating housing 750 may include at least one coupling boss 751 formed in an upper end thereof to be coupled to the LED module 400. The coupling boss may be a protrusion that extends vertically from a top edge of the heat-insulating housing 750. Moreover, the coupling boss 751 may be formed at a distal end of a guide rib 755 formed on the housing 750. The coupling boss 751 may be directly coupled with the LED module 400 by the connector b. At this time, the connector b may be configured to bypass the heat sink 600 such that it does not physically contact the heat sink 600.

For example, if the connector b is formed of metal, it may create a short circuit between the LED module 400 and the heat sink 600. That is, if the connector b makes contact with the heat sink 600 when inserted through the heat sink 600 to couple the LED module 400 to the housing 750, an electrical shock or a short circuit may result between the LED module 400 and the metal heat sink 600. Moreover, the current supplied to the LED module 400 may leak into the heat sink 600 and may adversely affect the performance of the heat sink 600.

Hence, in this embodiment, the connector b may be configured to pass through the heat sink 600 without making physical contact with the heat sink 600. The coupling hole 610 may be provided on the bottom surface of the upper cavity 630 of the heat sink 600. The connector b then directly coupled to the coupling boss 751 of the heat-insulating housing 750 through the coupling hole 610.

For example, the upper cavity 630 may be provided in an upper portion of the heat sink 600 and configured to receive the LED module therein. The coupling boss 751 of the heat-insulating housing 750 may protrude into the upper cavity 630 from the lower cavity 650 via the coupling hole 610 formed on the mounting plate 631 (dividing wall) separating the upper cavity 630 and the lower cavity 650. A diameter or width of the coupling hole 610 may be formed to be greater than a diameter or width of the connector b. The diameter or width of the coupling hole 610 may also be formed to be greater than or equal to a width of the coupling boss 751 such that the coupling boss 751 may protrude through the coupling hole 610 into the upper cavity 630. The connector b may then couple the LED module 400 to the heat-insulating housing 750 without touching the heat sink 600. That is, because coupling hole 610 is formed to be wider than the width of the connector b, the connector b may pass through the heat sink 600 without making contact therewith. The connector, the coupling holes 310, 410, 510, 610, and the coupling boss 751 are disclosed in further detail with reference to FIGS. 4A and 4B hereinbelow.

Moreover, a connecting hole 620 may be provided on the mounting plate 631 of the heat sink 600 to allow the electrical control module 730 to be electrically connected to the LED module 400. For example, the electrical control module 730 may be positioned in the lower cavity 650 while the LED module 400 may be positioned in the upper cavity 630. The output of the AC-DC converter may be connected to the LED module 400 through wires fed through connecting hole 620.

The electrical components of the electrical control module 730 may be positioned inside the cavity 753 of the heat-insulating housing 750 when assembled inside lower cavity 650 of the heat sink 600. Hence, the heat-insulating housing 750 may insulate the electrical components from the heat formed on the heat sink 600. Moreover, in certain embodiments, an insulating plate may be provided over the cavity 753 to provide additional insulation for the electrical components. For example, the insulating plate may be formed to correspond to the opening of the cavity 753 on the heat-insulating housing 750. The insulating plate may then protect the electrical components from heat directed from the dividing wall 631 between the upper and lower cavities 630 and 650 of the heat sink 600. In certain embodiments, the cavity 753 of the heat-insulating housing 750, with the electrical control module 730 positioned therein, may be filled with an insulating material, such as a resin or foam, to provide added thermal insulation. It should be appreciated that the insulating plate and the insulating resin or foam may also provide electrical insulation for the electrical components positioned inside the heat-insulating housing 750.

An electrical connector 780 may be provided on a lower portion of the base 700 to supply commercial voltage to the electrical control module 730. The electrical connector 780 may be connected to a corresponding commercial voltage supply connector to receive power. The electrical connector 780 may be a screw type, plug-in type, or another appropriate type of electrical connector or socket.

In this embodiment, the base 700, having the heat-insulating housing 750, the electrical control module 730, and the electrical connector 780, may be inserted into the lower cavity 650 of the heat sink 600. The heat sink 600 may be coupled to the LED module 400 and the heat-insulating housing 750. That is, the connector b may couple the LED module 400 to the heat-insulating housing 750, with the heat sink 600 positioned therebetween. The connector b may be configured to couple the reflector 300, LED module 400, the heat conduction pad 500, the heat sink 600, and the heat-insulating housing 750 to each other through respective coupling holes 310, 410, 510, 610 and the coupling boss 751, while maintaining electrical isolation between the connector b and the heat sink. Accordingly, the number of connectors necessary to connect each component of the lighting device 1000 may be reduced and the assembly process may be simplified.

As shown in FIG. 3, a guide rib 755 may be provided on an outer side surface of the heat-insulating housing 750. The guide rib 755 may guide the insertion of the heat-insulating housing 750 into the lower cavity 650 of the heat sink 600. A coupling boss 751 may be formed at a top end of the guide rib 755 and configured to be connected to the LED module 400 as disclosed in detail hereinbelow. In addition, a guide groove 651 may be provided on an inner side surface of the lower cavity 650 of the heat sink 600. The guide groove 751 may be positioned to correspond to a position of each guide rib 755 such that the guide rib 755 is seated inside the guide groove 651.

The placement of the guide rib 755 and the guide groove 651 may be reversed such that the guide rib 755 is positioned on the heat sink 600 and the guide groove 651 is positioned on the heat-insulating housing 750. Moreover, the number of guide rib 755 and guide groove 651 may be variable. If more than one pair of guide rib 755 and guide groove 651 are provided, they may be spaced at different intervals such that they may guide an orientation of the base 700 inside the lower cavity 650. That is, the base 700 may be keyed to the lower cavity 650 by the guide rib 755 and guide groove 651.

A hooking protrusion 757 which may limit an insertion depth of the heat-insulating housing 750 may be provided on the outer side surface of the heat-insulating housing 750. The insertion depth of the heat-insulating housing 750 may be limited because the hooking protrusion 757 may be hooked to the lower end of the heat sink 600. Moreover, the height of the coupling boss 751 may be formed to be a height such that the coupling boss 751 protrudes through the coupling hole 610 into the upper cavity 630 or is coplanar with the mounting surface 631. For example, the coupling boss 751 may be formed at a top end of the guide rib 755, to extend vertically from the top edge of the housing 750. When the housing 750 is positioned inside the lower cavity 650, the top edge of the housing 750 may be positioned adjacent to the top surface of the lower cavity 650. Each coupling boss 751 may then be inserted into a corresponding coupling hole 610 such that the top end of the coupling boss 751 is coplanar with the mounting surface in the upper cavity 630. For example, a height of the coupling boss 751 may be formed to be the same as the thickness of the mounting plate 631.

Accordingly, the LED module 400 may be connected to both the heat sink 600 and the heat-insulating housing 750 such that it is thermally connected to the heat sink 600 while also being electrically isolated from the heat-insulating housing 750. The heat conduction pad 500 positioned on the bottom surface of the upper cavity 630 may increase the thermal conductivity between the LED module 400 and the heat sink 600.

Once the connector b is inserted into the coupling boss 751, the diffusing cap 200 may be mounted in the upper portion of the heat sink 600 and the electrical connector 780 may be mounted in the lower portion of the heat-insulating housing 750 to complete assembly of the lighting device 1000. The diffusing cap 200 may include at least one hooking protrusion 240 to mount the diffusing cap 200 to the heat sink 600. The hooking protrusion 240 may be positioned on the outer surface of the diffusing cap 200 near the portion which makes contact with the heat sink 600. The heat sink 600 may include at least one hooking groove 640 which may be positioned to correspond to the position of the hooking protrusions 240. The hooking protrusion 240 may be placed in the hooking groove 640 to attach the diffusing cap 200 to the heat sink 600. The hooking protrusion 240 may be formed to extend laterally from the side surface of the diffusing cap 200 and shaped at an angle on a surface that faces the hooking groove 640 such that it may be easily inserted into the hooking groove 640.

Simply for ease of explanation, the hooking protrusion 240 is disclosed herein as being positioned on the diffusing cap 200 and the hooking groove 640 is positioned on the inner side surface of the upper cavity 630 formed in the heat sink 600. However, it should be appreciated that the hooking protrusion 240 may be positioned on the heat sink 600 while the hooking groove 640 may be positioned on the diffusing cap 200. Moreover, the number and positions of the hooking protrusion 240 and hooking groove 640 may be variable. In certain embodiments, the hooking protrusion 240 and hooking groove 640 may extend around the circumference of the diffusing cap 200 and the heat sink 600, respectively.

Figure 4:
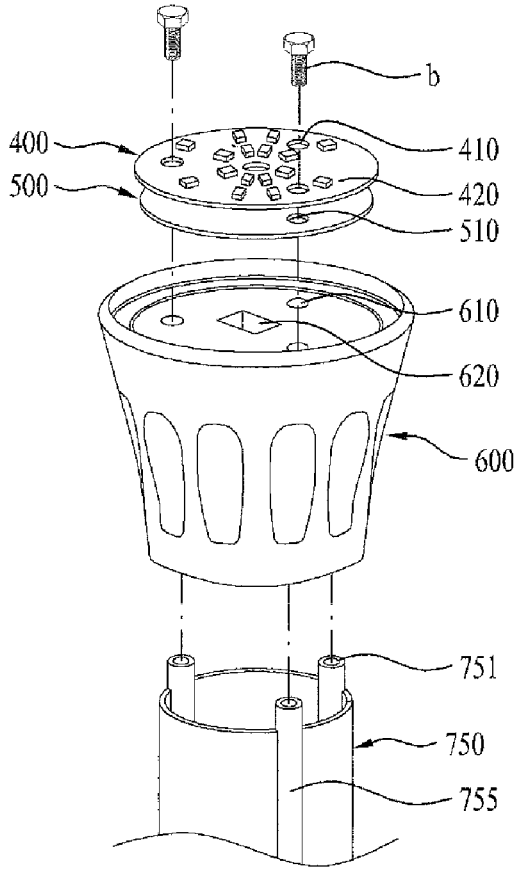
FIG. 4A is another exploded perspective view of the lighting device.
FIG. 4B is a partial sectional view of the lighting device.
Figure 4:
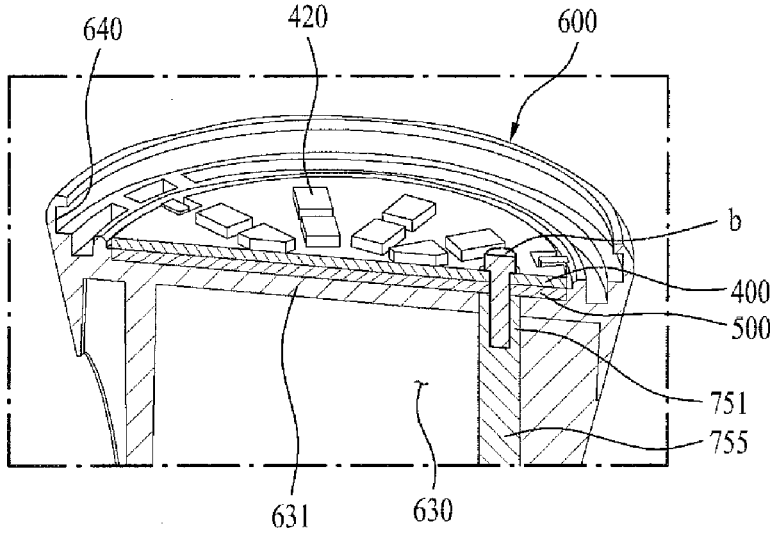

FIGS. 4A and 4B are an exploded perspective view and a cross-sectional view of the lighting device. FIG. 4B is a cross-sectional view of the lighting device of FIG. 4A illustrating a position of the coupling boss 751 when connected to the LED module 400 and the heat sink 600.

The LED module 400 may be coupled to the coupling boss 751 of the heat-insulating housing 750 by the connector b. For example, the connector b may be configured to simultaneously couple the reflector 300, LED module 400, the heat conduction pad 500, the heat sink 600, and the heat-insulating housing 750 to each other through each respective coupling holes 310, 410, 510, 610 and a coupling boss 751. As shown in FIG. 4B, the coupling boss 751 of the heat-insulating housing 750 may pass though the mounting plate 631 via coupling hole 610 into the upper cavity 630 of the heat sink 600 to be exposed inside the upper cavity 630.

For example, the upper cavity 630 may be provided in an upper portion of the heat sink 600 and configured to receive the LED module 400 therein. The heat-insulating housing 750 may be positioned inside the lower cavity 650. The coupling boss 751 of the heat-insulating housing 750 may formed to protrude through the coupling hole 610 on the mounting plate 631 from the lower cavity 650 into the upper cavity 630. A diameter or width of the coupling hole 410 on the LED module 400 may be formed to be equal to a diameter or width of the connector b. However, the diameter or width of the coupling hole 610 of the heat sink 600 may be formed to be greater than the width of the connector b such that the connector does not make physical contact with the heat sink 600. Moreover, the diameter or width of the coupling hole 610 of the heat sink may be formed to be equal or greater than a diameter or width of the coupling boss 751 such that the coupling boss 751 may protrude through the coupling hole 610. When assembled, the coupling boss 751 be formed to be coplanar with a bottom surface of the upper cavity 630. Accordingly, the LED module 400 may be thermally coupled but electrically isolated to the heat sink 600.

In certain embodiments, the coupling boss 751 may not protrude into the upper cavity 630. For example, the coupling boss 751 may be positioned adjacent to a top surface of the lower cavity 650 (bottom surface of the mounting plate 631). Alternatively, the coupling boss 751 may be positioned inside a recess formed on the top surface of the lower cavity 350. This recess may be shaped to correspond to the shape of the coupling boss 751. T width of the coupling hole 631 in the heat sink 600 may be wider than the width of the connector 751 such that the connector (and the LED module 400) may be electrically isolated from the heat sink 600. Here, the width of the coupling holes 410, 510 on the LED module 400 and heat conduction pad 500 may be formed to be the same as the width of the connector 751.

Simply for ease of explanation, the connector b is described herein as a screw or bolt which may be formed of metal. However, this disclosure is not limited thereto. In yet another embodiment, the connector b may be a rivet connected through the heat sink 600 from the LED module 400 to the coupling boss 751. The connector b may be a push type rivet that may be pressed into the coupling boss 751 to be secured therein. Moreover, the connector b may be formed of an insulating material, such as a plastic, nonconductive resin, or another appropriate type of nonconductive material. Alternatively, the connector b may be coated with a nonconductive insulating material to prevent possible short circuits with the heat sink 600.

Figure 5:
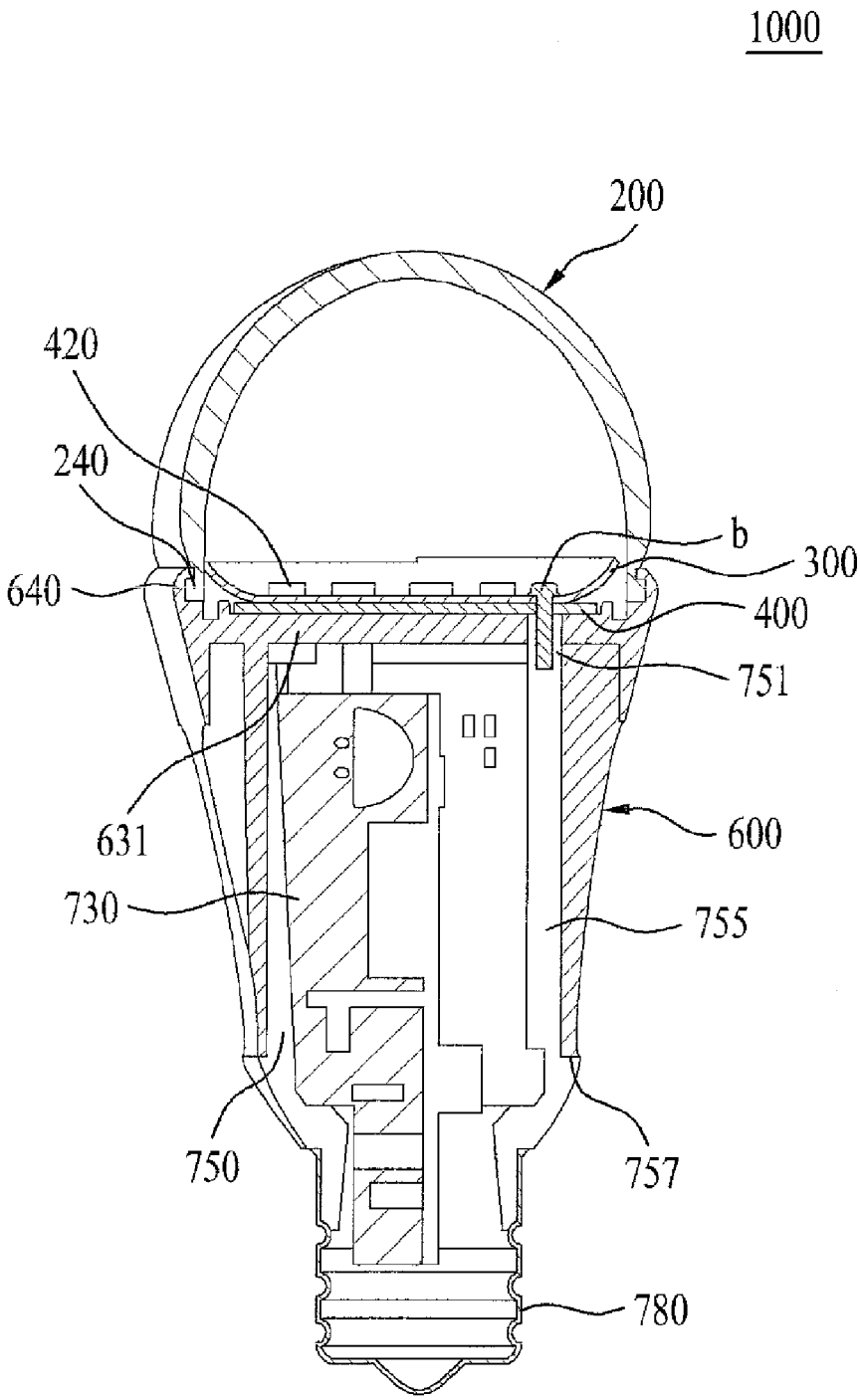
FIG. 5 is a sectional view of the lighting device.

FIG. 5 is a cross-sectional view of the lighting device according to the present disclosure. Referring to FIG. 5, the LED module 400 and the heat-insulating housing 750 may be coupled to each other by the connector b. The heat sink 600 may be positioned between the LED module 400 and the heat-insulating housing 750. As a result, the number of the connectors b required to couple the various components of the lighting device to each other may be reduced. Moreover, the LED module 400 may be electrically isolated from the heat sink. For example, the coupling boss 751 of the heat-insulating housing 750 may be protrude through the mounting plate 631 of the heat sink 600 to be exposed to the upper cavity 630. Thus, the LED module 400 and the heat conduction pad 500 may be positioned on the heat sink 600 while being connected to the coupling boss 751. As a result, the LED module 400 and the heat sink 600 may be thermally coupled to improve the heat dissipation of the LED module 400 while electrically isolated to prevent electric shock or poor device performance.

As previously discussed, the guide rib 755 may be formed on the heat-insulating housing 750 and the guide groove 651 may be formed on the heat sink 600 to guide the heat-insulating housing 750 into the lower cavity 650 of the heat sink 600. Moreover, the diffusing cap 200 and the electrical connector 780 may be assembled without the use of an auxiliary connector b. As a result, the productivity and efficiency during assembly of the lighting device may be improved and costs of the lighting device may be reduced.

A lighting device as embodied and broadly described herein may include a light emitting element; a light emitting module having the light emitting element mounted therein; a heat sink configured to radiate heat generated from the light emitting module; a heat conduction pad provided between the light emitting module and the heat sink, and a housing mounted in a lower portion of the heat sink to be connected with the light emitting module, the housing being made of a heat-insulating material.

An inserting space (lower cavity) may be provided in a lower portion of the heat sink to insert and mount the housing therein. The housing may include a plurality of coupling bosses provided in an upper end thereof. The coupling bosses may be configured to pass through the heat sink and coupled to the light emitting module.

A securing space (upper cavity) may be provided in an upper portion of the heat sink. The coupling bosses of the housing may be exposed to the securing space via a coupling hole formed on a bottom surface of the securing space. A coupling member (fastener or connector) may be configured to connect the light emitting module to the housing and may be coupled to the coupling hole, passing through a substrate of the light emitting module.

In certain embodiments, a lighting device may include a light emitting module having a light emitting element mounted therein; a heat sink provided in a lower portion of the light emitting module; and a heat-insulating member provided in a lower portion of the heat sink. The light emitting module may be connected to the heat-insulating member in non-contact with the heat sink.

The heat-insulating member may accommodate an electrical control part configured to convert a commercial voltage into an input voltage of the light emitting module. Moreover, the heat sink may include a securing space formed in an upper portion thereof to secure the light emitting module therein and an inserting space formed in a lower portion thereof to insert the heat-insulating member therein, wherein the heat-insulating member may accommodate the electrical control part.

A guide rib may be provided in one of an inner side of the heat sink or an outer side of the heat-insulating member along an inserting direction of the heat-insulating member. A guide groove may be provided in the other of the heat sink or heat-insulating member to insert the guide protrusion therein. Moreover, at least one coupling boss may be provided in an upper end of the heat-insulating member. At least one coupling hole may be formed in the heat sink and the coupling boss of the heat-insulating member may be formed in a predetermined location that corresponds to a location of the coupling hole. The coupling boss may be exposed to the securing space via the coupling hole.

The coupling member which may be configured to connect the light emitting module with the heat-insulating member may be coupled along a direction from a top of the light emitting module toward the heat-insulating member. The coupling member may be inserted through the coupling holes to connect each component. A conduction pad may be provided between the light emitting module and the heat sink.

An electrode socket which may be electrically connected with the electrical control unit accommodated in the heat-insulating member may be provided in a lower portion of the heat-insulating member. The lighting device may further include a reflecting member provided in an upper portion of the light emitting module. The reflecting member may include a plurality of LED holes which may be configured to expose the light emitting elements therethrough. The lighting device may further include a diffusing cap provided on the reflecting member. A hooking protrusion may be provided in one of the diffusing cap or the heat sink and a hooking groove to insert the hooking protrusion therein may be provided in the other of the diffusing cap or the heat sink.

In another embodiment, a lighting device may include a light emitting module having a light emitting element mounted therein; a heat sink configured to radiate heat generated from the light emitting module; and a base comprising an electrical control part configured to convert a commercial voltage into an input voltage of the light emitting module. The base may be connected to the light emitting module with the heat sink located therebetween.

In the lighting device as disclosed herein, the heat insulation function of the heat sink, which may be configured to radiate the heat generated from the light emitting element, may be improved. Furthermore, assembly efficiency of the housing, which may be coupled with the light emitting module and the heat sink, may be improved. For example, a number of connectors necessary to connect the components of the lighting device to each other may be reduced. As a result, assembly efficiency of the lighting device may be improved.

A lighting apparatus, as embodied and broadly disclosed herein, may include a heat sink having a first surface positioned opposite a second surface; a light emitting diode module provided over the first surface, wherein the light emitting diode module is thermally coupled to the heat sink; a housing positioned on the second surface, wherein the housing is thermally insulated from the heat sink; and at least one fastener that attaches the light emitting diode module to the housing.

In this embodiment, the at least one fastener may be a connector that is electrically isolated from the housing, wherein the at least one fastener may be a connector configured to connect the light emitting diode module to the housing without contacting the heat sink. Moreover, the connector may be connected to the housing through a first hole positioned on the light emitting diode module and a second hole positioned through the first and second surfaces of the heat sink. In this lighting apparatus, a width of the second hole positioned on the heat sink may be greater than a width the first hole and a width of the connector.

In the lighting device of this embodiment, the heat sink may include a first cavity adjacent to the first surface and a second cavity adjacent to the second surface, and wherein the light emitting diode module is positioned inside the first cavity and a portion of the housing is positioned inside the second cavity, wherein the housing includes at least one protrusion configured to be coupled to the connector. Furthermore, the at least one protrusion extends from the first cavity to the second cavity through a hole positioned through the first and second surfaces the heat sink, wherein the at least one fastener may be positioned through the hole to attach the light emitting diode module to the housing, and wherein the at least one fastener may be configured to not contact the heat sink, and wherein a width of the hole may be greater than a width of the at least one fastener.

In the lighting device of this embodiment, the housing may includes a recess to house electrical components that converts an external voltage into an input voltage compatible with the light emitting module. The housing may also include an electrical socket provided on an external surface of the housing to receive the external voltage from an external power source. Moreover, the heat sink may include a first cavity adjacent to the first surface and a second cavity adjacent to the second surface, wherein the light emitting diode module may be positioned inside the first cavity and a portion of the housing that houses the electrical components may be positioned inside the second cavity.

In the lighting device of this embodiment, the housing may include at least one guide rib provided on an outer side surface of the housing, and the heat sink may include at least one guide groove provided on an inner side surface of the heat sink, wherein the at least one guide rib and the at least one guide groove may be positioned to correspond to each other. Moreover, the protrusions may be integrally formed at a distal end of the guide rib.

The lighting device may further include a heat conduction pad provided on the first surface of the heat sink between the light emitting diode module and the heat sink, and a reflector provided over the light emitting diode module, the reflector including a plurality of LED holes positioned to correspond to a position of a plurality of LEDs provided on the light emitting diode module. Moreover, this lighting device may further include a diffusing cap provided over the reflector, wherein the diffusing cap may include at least one hooking protrusion and the heat sink may include at least one hooking groove positioned to correspond to the at least one hooking protrusion, and wherein the at least one hooking protrusion may be configured to be inserted into the hooking groove to attach the diffusing cap to the heat sink.

In another embodiment, a lighting device may include a light emitting module having a plurality of LEDs mounted thereon; a heat sink configured to dissipate heat generated from the light emitting module; and a base that houses electrical components configured to provide power to the light emitting module, wherein the heat sink may be positioned between the base and the light emitting module, and configured to be electrically insulated from the light emitting module and thermally insulated from the base.

In yet another embodiment, a lighting device may include an LED module having a plurality of LEDs mounted thereon; a heat sink positioned below the LED module; a thermally insulated base positioned below the heat sink; and a connector configured to attach the LED module, the heat sink, and the base to each other, wherein the connector may attach the LED module to the base without touching the heat sink.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a heat sink having a first surface positioned opposite a second surface;

a light emitting diode module provided over the first surface, wherein the light emitting diode module is thermally coupled to the heat sink;

a housing positioned on the second surface, wherein the housing is thermally insulated from the heat sink; and at least one fastener that attaches the light emitting diode module to the housing without contacting the heat sink, wherein the at least one fastener is fastened to the housing such that the at least one fastener passes through the light emitting diode module and the heat sink.

2. The lighting apparatus of claim 1, wherein the at least one fastener is a connector that is electrically isolated from the housing.

3. The lighting apparatus of claim 1, wherein the at least one fastener is a connector configured to connect the light emitting diode module to the housing without contacting the heat sink.

4. The lighting apparatus of claim 1, wherein the connector is connected to the housing through a first hole positioned on the light emitting diode module and a second hole positioned through the first and second surfaces of the heat sink.

5. The lighting apparatus of claim 4, wherein a width of the second hole positioned on the heat sink is greater than a width the first hole and a width of the connector.

6. The lighting device of claim 1, wherein the heat sink includes a first cavity adjacent to the first surface and a second cavity adjacent to the second surface, and wherein the light emitting diode module is positioned inside the first cavity and a portion of the housing is positioned inside the second cavity.

7. The lighting device of claim 6, wherein the housing includes at least one protrusion configured to be coupled to the connector.

8. The lighting device of claim 7, wherein the at least one protrusion extends from the first cavity to the second cavity through a hole positioned through the first and second surfaces the heat sink.

9. The lighting device of claim 8, wherein the at least one fastener is positioned through the hole to attach the light emitting diode module to the housing, and wherein the at least one fastener does not contact the heat sink.

10. The lighting device of claim 9, wherein a width of the hole is greater than a width of the at least one fastener.

11. The lighting device of claim 7, wherein the housing includes at least one guide rib provided on an outer side surface of the housing, and the heat sink includes at least one guide groove provided on an inner side surface of the heat sink, wherein the at least one guide rib and the at least one guide groove are positioned to correspond to each other.

12. The lighting device of claim 11, wherein the protrusions are integrally formed at a distal end of the guide rib.

13. The lighting device of claim 1, wherein the housing includes a recess to house electrical components that converts an external voltage into an input voltage compatible with the light emitting module.

14. The lighting device of claim 13, wherein the housing includes an electrical socket provided on an external surface of the housing to receive the external voltage from an external power source.

15. The lighting device of claim 13, wherein the heat sink includes a first cavity adjacent to the first surface and a second cavity adjacent to the second surface, and wherein the light emitting diode module is positioned inside the first cavity and a portion of the housing that houses the electrical components is positioned inside the second cavity.

16. The lighting device of claim 1, further comprising a heat conduction pad provided on the first surface of the heat sink between the light emitting diode module and the heat sink.

17. The lighting device of claim 1, further comprising:

a reflector provided over the light emitting diode module, the reflector including a plurality of LED holes positioned to correspond to a position of a plurality of LEDs provided on the light emitting diode module.

18. The lighting device of claim 17, further comprising a diffusing cap provided over the reflector, wherein the diffusing cap includes at least one hooking protrusion and the heat sink includes at least one hooking groove positioned to correspond to the at least one hooking protrusion, and wherein the at least one hooking protrusion is configured to be inserted into the hooking groove to attach the diffusing cap to the heat sink.

19. A lighting device comprising:

a light emitting module having a plurality of LEDs mounted thereon;

a heat sink configured to dissipate heat generated from the light emitting module; and a base that houses electrical components configured to provide power to the light emitting module, wherein the heat sink is positioned between the base and the light emitting module, and configured to be electrically insulated from the light emitting module and thermally insulated from the base, wherein the LED module has a first hole having a first diameter and the heat sink has a second hole having a second diameter, the first and second holes accommodating a connector placed therethrough, wherein the connector attaches the LED module to the base without touching the heat sink.

20. A lighting device comprising:

an LED module having a plurality of LEDs mounted thereon;

a heat sink positioned below the LED module;

a thermally insulated base positioned below the heat sink; and a connector configured to attach the LED module, the heat sink, and the base to each other, wherein the connector attaches the LED module to the base without touching the heat sink, and wherein the LED module has a first hole having a first diameter and the heat sink has a second hole having a second diameter, and the connector is placed through the first and second holes.

* * * * *